US005357986A

United States Patent [19]

Hargrett

[11] Patent Number: 5,357,986

[45] Date of Patent: Oct. 25, 1994

[54] HAIR LOCKING PROCESS AND APPARATUS

[76] Inventor: Drucilla W. Hargrett, 9438 Prairie Ave., Chicago, Ill. 60619

[21] Appl. No.: 155,109

[22] Filed: Nov. 19, 1993

[51] Int. Cl.[5] ..... A41G 3/00

[52] U.S. Cl. ..... 132/201; 132/53; 132/54

[58] Field of Search ..... 132/53, 54, 56, 201

[56] References Cited

U.S. PATENT DOCUMENTS

| | | | |
|---|---|---|---|
| 289,957 | 12/1883 | Baxter | 132/56 |
| 1,199,144 | 9/1916 | Zak | 132/201 |
| 2,165,716 | 7/1939 | Molleson | 132/53 |
| 2,621,663 | 12/1952 | Jenkins | 132/201 |
| 2,865,380 | 12/1958 | Mitchell | 132/201 |
| 3,280,826 | 10/1966 | Jenkins | 132/53 |
| 4,176,669 | 12/1979 | Levin | 132/201 |
| 4,372,330 | 2/1983 | Nelson | 132/53 |
| 5,121,761 | 6/1992 | Meister | 132/53 |

*Primary Examiner*—Gene Mancene
*Assistant Examiner*—Frank A. LaViola
*Attorney, Agent, or Firm*—Wallenstein, Wagner & Hattis, Ltd.

[57] ABSTRACT

A method for attaching hair to the head (32) of a person, a flexible material with rings (12) woven into the hair (32) forming a flat braid (16). A weft of hair (24) with rings (12) communicating with the rings (12) in the flat braid (16). The rings (12) in flat braid (16) correspond with rings (12) on weft of hair (26). The corresponding rings (12A) are tightly locked together with needle (20) and thread (18).

8 Claims, 1 Drawing Sheet

Fig. 4
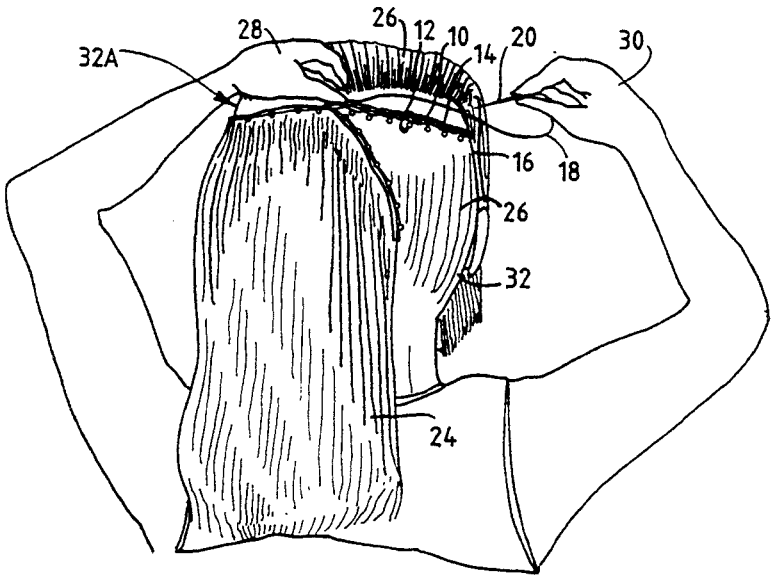
Fig. 5
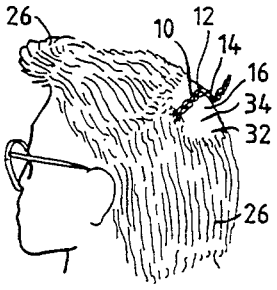
Fig. 2
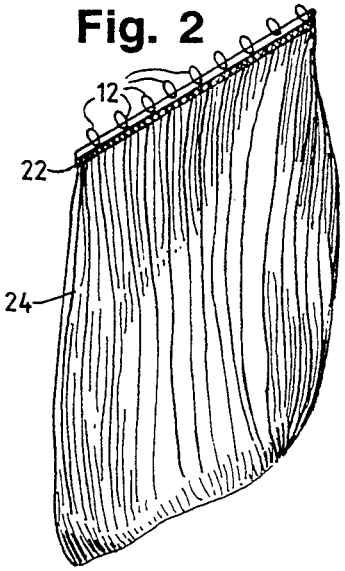
Fig. 1
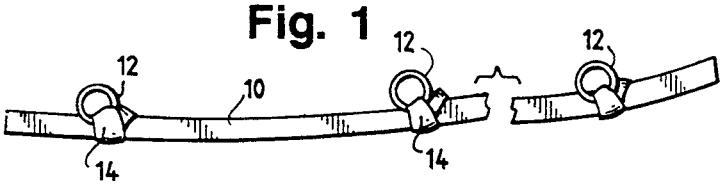
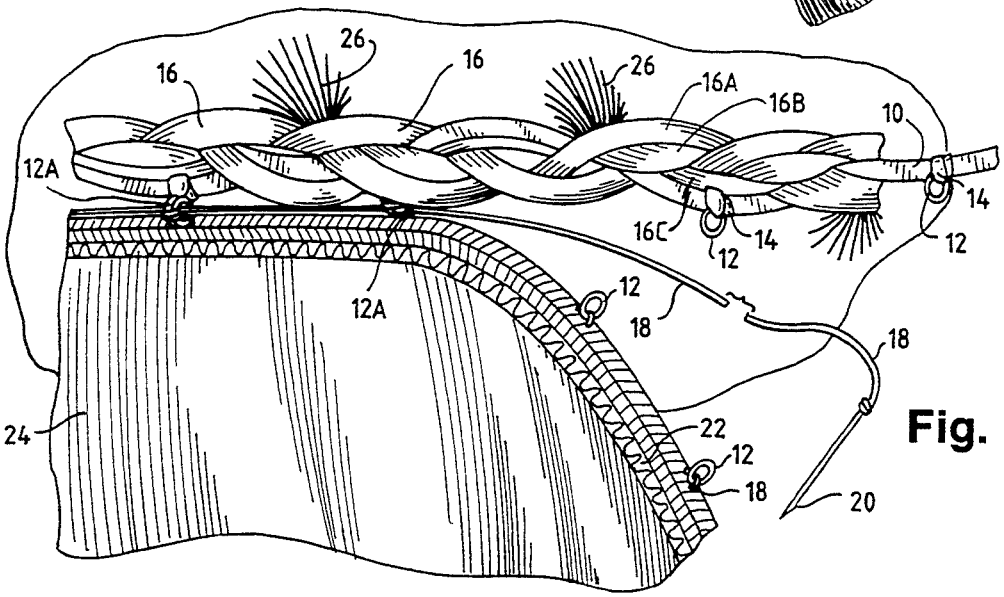
Fig. 3

HAIR LOCKING PROCESS AND APPARATUS

BACKGROUND—FIELD OF INVENTION

This invention relates to hair weaving, specifically an improved method for attaching hair to the head of a person.

BACKGROUND—DESCRIPTION OF PRIOR ART

Standard hair weaving is a process of attaching hair to a person's head. The hair is sectioned off and tightly braided. The weft of hair is sewn directly onto the braid with needle and thread. Consumers object to this method because the tight braids are uncomfortable and cause blisters. The thread used to sew the hair onto the braid blends into the person's hair and is difficult to see. During removal of the weft of hair, the person's own hair is damaged. Standard hair weaving is very expensive and extremely time consuming.

Bonding is a method of attaching hair to a person's head by applying latex glue to the weft of hair and placing it along a narrow part on the person's head. This process is fast but causes extreme damage to the hair. Many users are allergic to the glue and may cause irritation of the skin.

Fusion is another process of attaching hair to the head of a person. Glue is added to the end of a few strands of loose hair. These strands are applied to the end of the person's own hair. They are rubbed and twisted together quickly before the glue dries. This process continues until the desired area is covered. Combing and brushing the hair is impossible with this process. Heat and oil may not be applied to fused hair thus preventing curling and styling.

Loose-End-Braiding is a process of tying a small portion of loose hair to a small portion of a person's hair. The hair is braided to a length of approximately two to three centimeters then a knot is tied. The ends remain loose and flexible. The disadvantage of this process is that the knots can become loose and the hair falls off.

OBJECTS AND ADVANTAGES

Several objects and advantages of my patent are:

(a) to provide an improved, single and easy method of adding hair to the head of a person;

(b) to provide a method of adding hair to a person's head than can be done by the person herself/himself;

(c) to provide a method of adding hair to a person's head that is more economical and less time consuming;

(d) to provide a method of adding hair to a person's head that can be removed easily without hair lost and damage to the hair of the individual;

(e) to provide a method of adding hair to a person's head that is convenient to the user;

(f) to prove a method of adding hair to a person's head that gives the user a choice of color, texture and length;

(g) to provide a method of adding hair to a person's head that gives the user the opportunity to select the quantity (thickness) of hair to be added.

Further objects and advantages are to provide a method of adding hair to a person's head that will not irritate the scalp. The hair locking process can be done by a friend, a beautician and even the person herself/himself. My patent will provide convenience, a greater economical advantage and will be less time consuming.

The hair may be removed easily without hair loss or damage to the person's own hair. Due to the secure method of attaching the hair, it will never fall off. The hair may be combed, brushed, curled and styled without any problems. It feels secure, it looks natural and no one will know it is locked on.

DRAWING FIGURES

In the drawings, closely related figures have the same number but different alphabetic suffixes.

FIG. 1 shows the base cord, an array of rings tightly tied to a ribbon.

FIG. 2 shows a weft of hair with rings sewn on with needle and thread.

FIG. 3 shows a flat braid with and interwoven base cord and also showing the process of attaching a weft of hair to a flat braid.

FIG. 4 shows a full view of a person attaching a weft of hair to a flat braid.

FIG. 5 shows a head with a bald spot, a flat braid with interwoven base cord.

REFERENCE NUMERALS IN DRAWINGS

| | |
|---|---|
| 10 ribbon | 24 weft of hair |
| 12 rings | 26 hair on head of person |
| 12A corresponding rings | 28 left hand |
| 14 knots | 30 right hand |
| 16 flat braid | 32 head of person (user) |
| 16A, 16B, 16C Part of braid | 32A crown of head |
| 18 thread | 34 bald spot |
| 20 needle | |
| 22 weft edge | |

DESCRIPTION—FIGS. 1 TO 5

A flexible unit of the hair locking process of the present invention is illustrated in FIG. 1. The ribbon 10 is composed of rings 12 and knots 14. The ribbon 10 is looped around the ring 12 and pulled tightly forming a knot 14 to hold the rings securely. This flexible unit is the base cord. However, the base cord FIG. 1 can be made of any flexible material that can be tied to rings 12 such as thread, strings, twines, etc.

The ribbon 10 is typically 0.8 centimeters in thickness and may have a length of approximately 16 to 23 centimeters in length. The rings 12 have a thickness of approximate 1 millimeter and a diameter of approximately 0.4 centimeters. The base cord FIG. 1 which circles the crown or rear portion of the head is roughly 16 to 23 centimeters in length.

The weft of hair FIG. 2 shows rings 12 that are attached by needle 20 and thread 18 to the weft edge 22. The rings 12 are positioned approximately 1.5 centimeters apart. The weft edge is machine stitched (not shown) to form a weft of hair 24.

In FIG. 3 the base cord FIG. 1 is woven into the hair 26 to form a flat braid 16. The flat braid 16 has three parts. The two outer parts 16A and 16C are positioned to equal the center part 16B. Placing the base card FIG. 1 with 16B, and folding over 16B with base cord FIG. 1, then folding 16C over 16B with base cord repeatedly forming flat braid 16.

The weft of hair 24 is attached to the braid 16 by aligning the rings 12 of the flat braid 16 so that they communicate with the rings 12 on the weft of hair 24.

The corresponding rings 12A are sewn together by needle and thread thus locking the rings 12A together.

A full view of the hair locking process is illustrated in FIG. 4. The base cord FIG. 10 is woven into the flat braid 16. The rings 12 on the weft of hair 24 are communicating with the rings 12 in the flat braid 16. The left hand 28 finds the corresponding rings 12A and pushing the needle 20 and thread 18 through three times consecutively locking in the rings 12A together. This locking process is repeated along the entire length of the flat braid 16 and weft of hair 24.

The head 32 with a bald spot 34 is shown in FIG. 5. The base cord FIG. 1 is woven into the hair 26 producing the flat braid 16. The rings 12 are visible anticipating the attachment of weft of hair 24. A specially designed hair piece (not shown) may be made for a bald spot.

From the description above a number of advantages of my hair locking process become evident:

(a) the hair locking process is simple and easy to do.

(b) the hair locking process allows the individual to choose the texture and length of hair desired.

(c) the hair locking process can be done at home providing convenience to the user.

(d) the hair locking process is more economical because of the do-it-yourself process.

(e) the hair locking process can be done by a beautician or a friend.

OPERATION—FIGS. 1, 3, 4

The process of attaching hair to the head of a person is somewhat similar to the standard method of weaving (not shown). Namely, the hair 32 is sectioned off to make a narrow braid. The weft of hair 24 is sewn directly onto the braid. However, in the hair locking process the base cord FIG. 1 is woven into the flat braid 16. The rings 12 on the weft edge 22 are sewn to the rings 12 in the flat braid 16.

In FIG. 3 the rings 12 on the weft edge 22 are positioned to correspond with the rings 12 in the flat braid 16. The needle 20 with strong lengthy thread 18 is pushed through the corresponding rings 12A three times consecutively thus locking them together. This process continues to the end of the flat braid 16 and simultaneously the end of the weft of hair 24.

In FIG. 4 on illustration of the complete method of the hair locking process is shown. The left hand 28 is finding the rings on the weft of hair 24 and the rings 12 in the flat braid 16. The right hand 30 pushes the needle 20 and thread 18 through the corresponding rings three times consecutively locking them together. The locking process continues to the end of the flat braid 16 and at the same time the end of the weft of hair 24.

SUMMARY, RAMIFICATIONS, AND SCOPE

Accordingly, the reader will see that the hair locking process of this invention can be easily done by the person herself/himself, a beautician or a friend. The weft of hair can be removed easily without damage or loss of hair to the user. Furthermore, the hair locking process has the additional advantage because it can be done at home thus affording adequate accommodation and convenience. The hair locking process gives the user the privacy needed when covering a bald spot or adding hair to thin and wispy hair. The choices of texture, length and color are added advantages. The hair locking process is more economical, less time consuming and much more convenient than any other process.

Although the description above contains many specificities, these should not be construed as limiting the scope of the invention, but as merely providing illustrations of some of the preferred embodiments of this invention. For example, the hair locking process can be attached to hats, caps, and any other head wear. The hair may be in weft, loose or in extended braids. For bald spots, a specially designed hair piece can be made.

I claim:

1. A hair locking process for adding hair to the head of a person comprising the steps of:

weaving a base cord having a series of spaced first rings attached thereto into a flat braid; and, attaching a weft of hair having a corresponding series of second paced rings attached thereto to said flat braid by aligning and interconnecting said first rings to said second rings.

2. The process of claim 1 wherein said series of first rings are tied tightly to said second rings of said base cord comprised of a ribbon.

3. The process of claim 1 wherein the step of weaving a base cord into existing hair of the person forms said flat braid for attaching to said weft of hair.

4. The process of claim 4 wherein the step of attaching said weft of hair includes tightly sewing said first rings with needle and thread to said second rings for connecting said weft of hair to said flat braid.

5. The process of claim 1 wherein the step of attaching said weft of hair to said flat braid includes aligning said first rings with said corresponding second rings of said base cord and tightly sewing said first rings to said second rings with thread.

6. The process of claim 5 wherein the step of attaching said weft of hair includes placing said weft of hair on the head of the person, positioning said weft of hair so that said first rings correspond with said second rings, pushing said needle and thread through said corresponding rings three times consecutively for securing and repeating to an end of said flat braid and said weft of hair simultaneously.

7. A hair locking assembly for adding hair to the head of a person comprising:

a base cord having a series of spaced first rings attached thereto;

a weft of hair having a series of corresponding spaced second rings attached thereto; and, a means for attaching said first rings of said base cord to said second rings of said weft of hair to the head of the person, said means having each said first ring aligned with each said corresponding second ring and being sewn together by thread.

8. The hair locking assembly of claim 7 wherein said base cord includes a ribbon with said first rings attached thereto, said ribbon being woven into existing hair of the person forming a flat braid.

* * * * *

UNITED STATES PATENT AND TRADEMARK OFFICE

CERTIFICATE OF CORRECTION

PATENT NO. : 5,357,986

DATED : October 25, 1994

INVENTOR(S) : Drucilla W. Hargrett

It is certified that error appears in the above-indentified patent and that said Letters Patent is hereby corrected as shown below:

At Col. 2, line 57, between the words "edge" and "is" insert the reference number --22--.

At Col. 2, line 63, between the words "folding" and "over" insert the reference number --16A--.

Col. 4, line 16
In Claim 1, line 21, delete the word "paced" and insert the word --spaced--.

Col. 4 line 30
In Claim 4, line 30, delete the number "4" and insert the number --3--.

Signed and Sealed this

Twenty-eight Day of February, 1995

*Attest:*

Bruce Lehman

BRUCE LEHMAN

*Attesting Officer*

*Commissioner of Patents and Trademarks*